US010193248B2

(12) United States Patent
Shaw et al.

(10) Patent No.: US 10,193,248 B2
(45) Date of Patent: Jan. 29, 2019

(54) SYSTEM AND METHOD FOR RETAINING MEMORY MODULES

(71) Applicant: Crystal Group Inc., Hiawatha, IA (US)

(72) Inventors: James E Shaw, Ely, IA (US); Rachel Manson, Delmar, IA (US); Chase Marsden, Cedar Rapids, IA (US); Robert Graham, Cedar Rapids, IA (US); Brent Sievers, Cedar Rapids, IA (US); Shawn Castillo, Marion, IA (US)

(73) Assignee: Crystal Group, Inc., Hiawatha, IA (US)

( * ) Notice: Subject to any disclaimer, the term of this patent is extended or adjusted under 35 U.S.C. 154(b) by 0 days.

(21) Appl. No.: 15/692,289

(22) Filed: Aug. 31, 2017

(65) Prior Publication Data

US 2018/0062287 A1 Mar. 1, 2018

Related U.S. Application Data

(60) Provisional application No. 62/381,939, filed on Aug. 31, 2016.

(51) Int. Cl.
*H01R 13/629* (2006.01)
*H01R 12/70* (2011.01)
*H01R 12/73* (2011.01)

(52) U.S. Cl.
CPC ..... *H01R 12/7029* (2013.01); *H01R 12/737* (2013.01)

(58) Field of Classification Search
CPC ..... H05K 7/1409; H01R 13/62988; H01R 12/7029
USPC ..... 439/157, 160, 328, 327
See application file for complete search history.

(56) References Cited

U.S. PATENT DOCUMENTS 3,150,906 A * 9/1964 Chambon ..... H05K 7/1401 439/157
3,360,689 A * 12/1967 Haury ..... H05K 7/1425 361/754
5,074,800 A * 12/1991 Sasao ..... H01R 12/7005 439/157
5,419,712 A * 5/1995 Bellomo ..... H01R 12/7023 439/327
5,443,394 A * 8/1995 Billman ..... H01R 12/7005 439/155

(Continued)

*Primary Examiner* — Neil Abrams
(74) *Attorney, Agent, or Firm* — Simmons Perrine Moyer Bergman PLC

(57) ABSTRACT

The present invention is an apparatus and method for allowing for the use of commercial dual inline memory module (DIMM) in high shock and vibration environments while preserving serviceability. This system extends the performance of the standard Joint Electron Device Engineering (JEDEC) memory connectors in said environments without sacrificing high speed electrical performance. The system provides a simple clip which locks the module in place using the standard connector latches preventing relative motion of the connector and the DIMM thereby insuring uninterrupted computational performance. The clip may be formed with resilient ends that snap onto pivotal latching devices to prevent inadvertent opening of these latching devices. The clips may also include bumper spacers (205) on their opposite faces to engage bumper spacers of adjacent clips to maintain the modules in proper orientation.

15 Claims, 11 Drawing Sheets

(56) References Cited

U.S. PATENT DOCUMENTS 5,603,625 A * 2/1997 Tondreault ..... H05K 7/1409 439/157
6,007,357 A * 12/1999 Perino ..... H01R 12/7005 439/327
6,030,251 A * 2/2000 Stark ..... H01R 12/7005 439/377
6,045,385 A * 4/2000 Kane ..... G06F 1/183 439/327
6,394,831 B1 * 5/2002 Bowers ..... H05K 7/1431 439/327
6,517,369 B1 * 2/2003 Butterbaugh ..... H01R 12/707 439/327
6,545,877 B1 * 4/2003 Agha ..... H05K 7/1417 361/759
6,589,059 B2 * 7/2003 Perino ..... H05K 7/1431 439/331
6,611,058 B2 * 8/2003 Kinsman ..... H05K 3/301 257/727
6,767,230 B2 * 7/2004 Lai ..... H01R 12/7029 439/153
7,371,097 B1 * 5/2008 Pennypacker ..... H01R 13/6275 439/327
7,637,748 B2 * 12/2009 Chung ..... H01R 13/62988 439/59
7,922,506 B1 * 4/2011 Harlan ..... H01R 12/7005 439/160
7,955,100 B2 * 6/2011 Chung ..... H05K 7/20172 439/157
8,075,330 B1 * 12/2011 Deng ..... H01R 12/7005 439/328
8,113,863 B2 * 2/2012 Vrenna ..... H01R 12/721 439/327
8,403,689 B2 * 3/2013 Li ..... H01R 12/721 439/160
8,559,187 B2 * 10/2013 Peng ..... H05K 7/1431 361/798
8,665,587 B2 * 3/2014 Peng ..... G06F 1/185 361/679.31
8,771,001 B2 * 7/2014 Li ..... H01R 13/639 439/160
9,060,453 B2 * 6/2015 Cox ..... H05K 3/30
9,172,164 B2 * 10/2015 Tang ..... H01R 12/721
9,173,310 B2 * 10/2015 Crippen ..... H05K 5/0221
9,240,639 B2 * 1/2016 Tang ..... H01R 13/62988
9,252,528 B2 * 2/2016 Stock ..... H05K 1/141
9,329,643 B2 * 5/2016 Tobias ..... G06F 1/20
9,839,140 B2 * 12/2017 Cox ..... H05K 3/301
2003/0090879 A1 5/2003 Doblar et al.
2006/0055017 A1 3/2006 Cho et al.
2006/0126369 A1 6/2006 Raghuram
2006/0129712 A1 6/2006 Raghuram
2006/0129755 A1 6/2006 Raghuram
2007/0118692 A1 5/2007 Yu
2007/0136523 A1 6/2007 Bonella et al.
2007/0161275 A1 7/2007 McBroom et al.
2007/0189098 A1 8/2007 Hsieh
2007/0283054 A1 12/2007 Burton
2007/0287333 A1 12/2007 Shan et al.
2008/0007921 A1 1/2008 Pauley et al.
2008/0068900 A1 3/2008 Bhakta et al.
2008/0140952 A1 6/2008 Lee et al.
2008/0155211 A1 6/2008 Misbach
2008/0180899 A1 7/2008 Pearson et al.
2008/0207059 A1 8/2008 Shan et al.
2009/0034327 A1 2/2009 Yun et al.
2009/0119451 A1 5/2009 Haywood et al.
2009/0180260 A1 7/2009 Djordjevic
2009/0201711 A1 8/2009 Solomon et al.
2009/0211083 A1 8/2009 Bodenweber et al.
2009/0217102 A1 8/2009 Co
2010/0008034 A1 1/2010 Hinkle
2010/0042778 A1 2/2010 Tanguay et al.
2010/0091540 A1 4/2010 Bhakta et al.
2010/0128507 A1 5/2010 Solomon et al.
2010/0191904 A1 7/2010 Misbach
2011/0016268 A1 1/2011 Qawami et al.
2011/0029746 A1 2/2011 Lee et al.
2011/0085406 A1 4/2011 Solomon et al.
2011/0090749 A1 4/2011 Bhakta et al.
2011/0099317 A1 4/2011 Nishtala et al.
2011/0246743 A1 10/2011 Lee et al.
2011/0286175 A1 11/2011 Iyengar et al.
2011/0286179 A1 11/2011 Motschman et al.
2012/0151287 A1 6/2012 Le et al.
2012/0271990 A1 10/2012 Chen et al.
2012/0278524 A1 11/2012 Lee et al.
2013/0007356 A1 1/2013 Liu et al.
2013/0019048 A1 1/2013 Bland et al.
2013/0070410 A1 3/2013 Chen et al.
2013/0074339 A1 3/2013 Boraas et al.
2013/0114200 A1 5/2013 Wu et al.
2013/0135812 A1 5/2013 Barina et al.
2013/0151904 A1 6/2013 Le et al.
2013/0290589 A1 10/2013 Liu et al.
2014/0040569 A1 2/2014 Solomon et al.
2014/0095781 A1 4/2014 Qawami et al.
2014/0185227 A1 7/2014 Wu et al.
2014/0211404 A1 7/2014 Yang
2014/0241062 A1 8/2014 Jeseritz et al.
2015/0004824 A1 * 1/2015 Nguyen ..... G01R 31/041 439/345
2015/0033550 A1 2/2015 Boraas et al.
2015/0089279 A1 3/2015 Dodson et al.
2015/0127890 A1 5/2015 Brainard et al.
2015/0169238 A1 6/2015 Lee et al.
2015/0363107 A1 12/2015 Best et al.
2016/0011802 A1 1/2016 Berke
2016/0019138 A1 1/2016 Lee
2016/0070616 A1 3/2016 Tavallaei et al.
2016/0071610 A1 3/2016 Murakami
2016/0081217 A1 3/2016 Norton et al.
2016/0085670 A1 3/2016 Huang et al.
2016/0196073 A1 7/2016 Zhang et al.
2016/0270249 A1 * 9/2016 Kidd ..... H05K 7/1405
2018/0062287 A1 * 3/2018 Shaw ..... H01R 12/7029

* cited by examiner

SYSTEM AND METHOD FOR RETAINING MEMORY MODULES

CROSS REFERENCE TO RELATED APPLICATIONS

This application claims the benefit of the filing date of the provisional patent application having Ser. No. 62/381,939 filed Aug. 31, 2016, the contents of which is incorporated herein in its entirety by this reference.

FIELD OF THE INVENTION

The present invention generally relates to computers and electronic equipment, and more particularly relates to industrial and military computers, and even more particularly relates to methods and systems for providing rugged DIMM connections for use in demanding and hostile environments

BACKGROUND OF THE INVENTION

Server class compute platforms are typically not employed in environments that are harsh, such as military vehicles, construction vehicles, weapons platforms, space launch systems, and etc. These server platforms are becoming necessary because of the need for virtualization and compute density in smaller spaces. One of several obstacles requiring resolution is the fragility of the Joint Electron Device Engineering Council (JEDEC) style DIMM connector on these compute platforms. This connector is a high speed (electrical speeds in the 2-3 GHz range) interface using a leaf spring style contact which creates a line of surface electrical conduction where the spring side of the connector touches the circuit side of the DIMM via a gold plated pad on the circuit card. See FIG. 1.

When acceleration is imparted on the masses of the compute platform, the forces can exceed the contacts ability to maintain surface contact with the circuit card housing the memory chips. More frequently, the spring contact and the circuit card lose electrical connectivity when the chassis is distorted. This level of chassis deflection creates enough force to curve the motherboard, which drives the JEDEC latch up and the DIMM out of the connector, thereby creating a break in the electrical connectivity between the DIMM and the motherboard. The latch, which is designed to both retain the memory as well as extract the memory, is prone to creating a problem in shock and vibration. This is a particularly devastating event for these system architectures as they fail to operate normally thereafter until the connection is reestablished. Previous solutions have involved permanently bonding the DIMM into the connector of applying a retention band, which must be damaged on removal. The former is unserviceable while the latter requires depot repair.

Consequently, there exists a need for improved methods and systems for connecting JEDEC memory modules in a compute platform used in harsh environments, such as military vehicles, weapons platforms, and space launch systems, all done in a reliable and cost efficient manner.

SUMMARY OF THE INVENTION

It is an object of the present invention to provide a system and method for connecting memory modules via a DIMM connector in an efficient manner.

It is a feature of the present invention to utilize a retention clip.

It is an advantage of the present invention to reduce inadvertent disconnection of memory modules from a DIMM connector.

It is another feature of the present invention to include a bumper spacer between adjacent retention clips.

It is another advantage of the present invention to provide a self-alignment capability for a plurality of adjacent retention clips.

It is yet another feature of the present invention to have a tab on the ends of clip.

It is still another advantage of the present invention to further deter rotation of a connector latch.

It is still another feature to have a lid contacting surface on the retention clip.

It is still another advantage of the present invention to provide a lid induced clamping force on a connector latch.

It is yet another feature to include a memory module mounted retention clip.

It is still an advantage to reduce a possibility of loose pieces occurring inside the system.

The present invention is an apparatus and method for making more robust the connections between a memory module and a JEDEC style DIMM connector to satisfy the aforementioned needs, provide the previously stated objects, include the above-listed features, and achieve the already articulated advantages. The present invention is carried out in a "inadvertent latch rotation-less" manner in a sense that the likelihood, of an unwanted disconnection of a memory module has been greatly reduced.

Accordingly, the present invention is a system comprising:

- A system for reducing inadvertent disconnection of memory modules during operation in harsh environments comprising:
  - a plurality of disconnection protected systems arranged in a parallel array; wherein each of said plurality of disconnection protected systems comprises:
    - a DIMM connector 120;
    - a DIMM memory module 110, having a memory module top edge 108;
    - a retention clip 200 having:
      - a retention clip central portion 208, having a retention clip first end 202 and retention clip second end 204;
      - a retention clip first angled portion 212 and retention clip second angled portion 214 disposed on opposing ends of said retention clip central portion 208;
      - a retention clip first latch engaging end 222 and a retention clip second latch engaging end 224 disposed on said retention clip first angled portion 212 and retention clip second angled portion 214, respectively;
      - said retention clip central portion 208 having a retention clip central portion top side 209 and a retention clip central portion bottom side 207, which has a retention clip bottom side top edge receiving groove 203 disposed therein, which is configured to receive therein said memory module top edge 108;
      - a plurality of retention clip first face bumper spacers 206;
      - a plurality of retention clip second face bumper spacers 205;
      - a retention clip first latch engaging tab 232 disposed on an interior side of said retention clip first latch engaging end 222;

a retention clip second latch engaging tab 234 disposed on an interior side said retention clip second latch engaging end 224 facing said retention clip first latch engaging tab 232; and wherein said array is spatially configured such that each retention clip 200 in said plurality of disconnection protected systems has at least one of said plurality of retention clip first face bumper spacers 206 and said plurality of retention clip second face bumper spacers 205 thereon in contact with one of said plurality of retention clip first face bumper spacers 206 and said plurality of retention clip second face bumper spacers 205 of another retention clip 200 of said plurality of disconnection protection systems.

Accordingly, the present invention is a method comprising the steps of:

A method of reducing inadvertent disconnection of memory modules during operation in harsh environments comprising the steps of:

providing a retention clip configured with a retention clip first latch engaging end 222 and a retention clip second latch engaging end 224:

installing a DIMM memory module 110 into a DIMM connector 120 having a first pivoting latch 122 and a second pivoting latch 124; and engaging said retention clip with all of said DIMM memory module 110; and engaging said retention clip first latch engaging end 222 and said retention clip second latch engaging end 224 with said first pivoting latch 122 and said second pivoting latch 124, respectively.

BRIEF DESCRIPTION OF THE DRAWINGS

The invention may be more fully understood by reading the following description of the preferred embodiments of the invention, in conjunction with the appended drawings wherein.

DETAILED DESCRIPTION

Through this description details are given of a DIMM and a DIMM connector, it should be understood that different circuit cards with different types of electronic components could be used with different connector sizes and configurations. It is intended that these specific details not limit the scope of the present invention but instead fully enable a one specific and best mode of the invention and other variations of this card and connector types are intended to be readily understood from the following description and included within the scope and spirit of the present invention.

Figure 1:
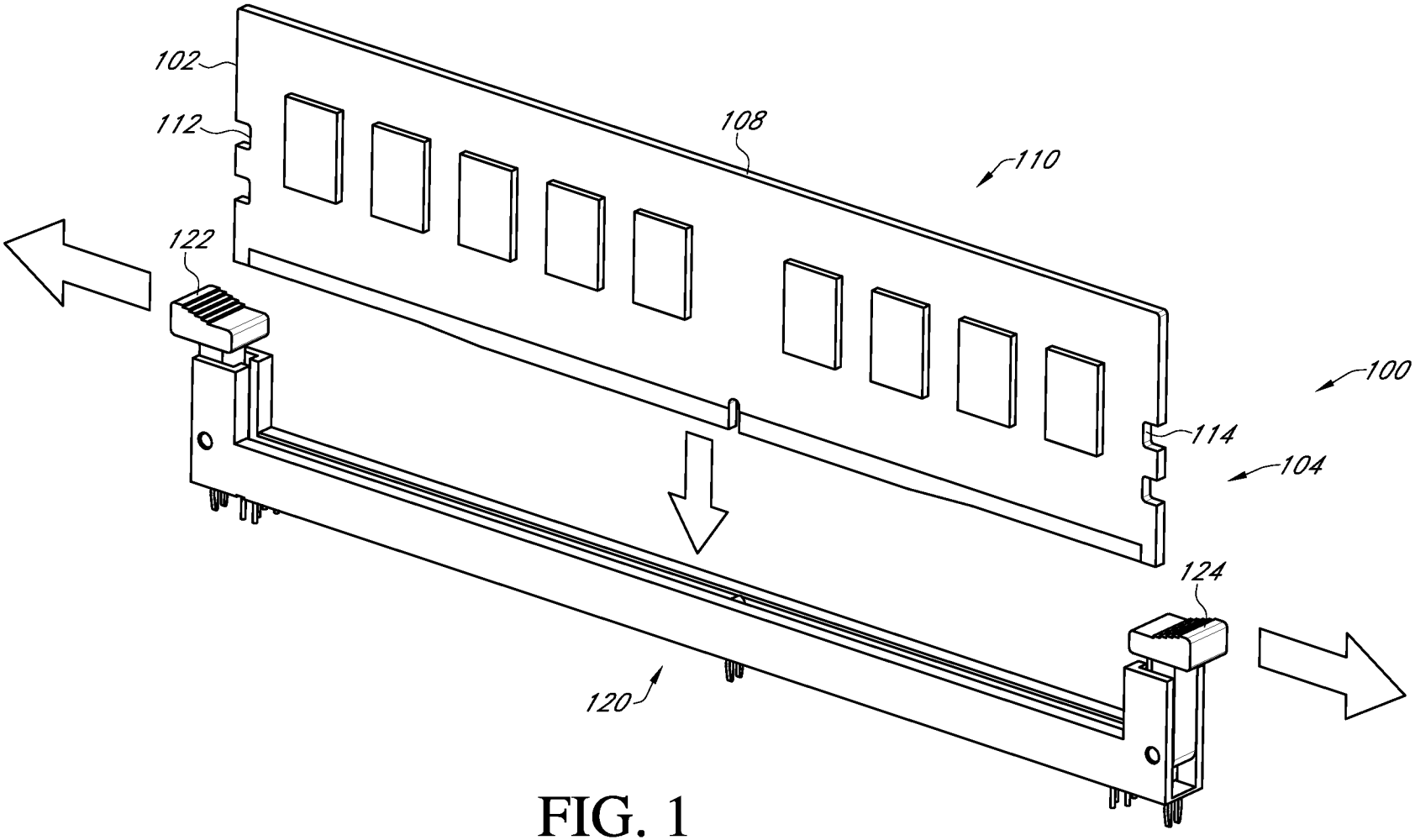
FIG. 1 (PRIOR ART)
FIG. 1 is an exploded perspective view of a prior art latchable DIMM connector system.

Now referring to the drawings wherein like numerals refer to like matter throughout, and more specifically referring to FIG. 1, there is shown a system of the prior art, generally designated 100, including a prior art DIMM and connector 100 including a DIMM memory module 110 and a DIMM connector 120. DIMM memory module 110 has a first end 102, a second end 104, a first end card notch 112 which provides a location for latching, a second end card notch 114 and a memory module top edge 108. In a manner which is well known in the art, the DIMM memory module 110 is inserted into DIMM connector 120, which cause first pivoting latch 122 and second pivoting latch 124 to rotate upwardly and latch at first end card notch 112 and second end card notch 114, respectively. In such prior art systems the DIMM memory module 110 can be removed by pushing outwardly (moving away from each other) on an upper portion of first pivoting latch 122 and second pivoting latch 124. If these upper portions are pushed away from each other simultaneously, the DIMM memory module 110 may be ejected from DIMM connector 120 into the air.

Figure 2:
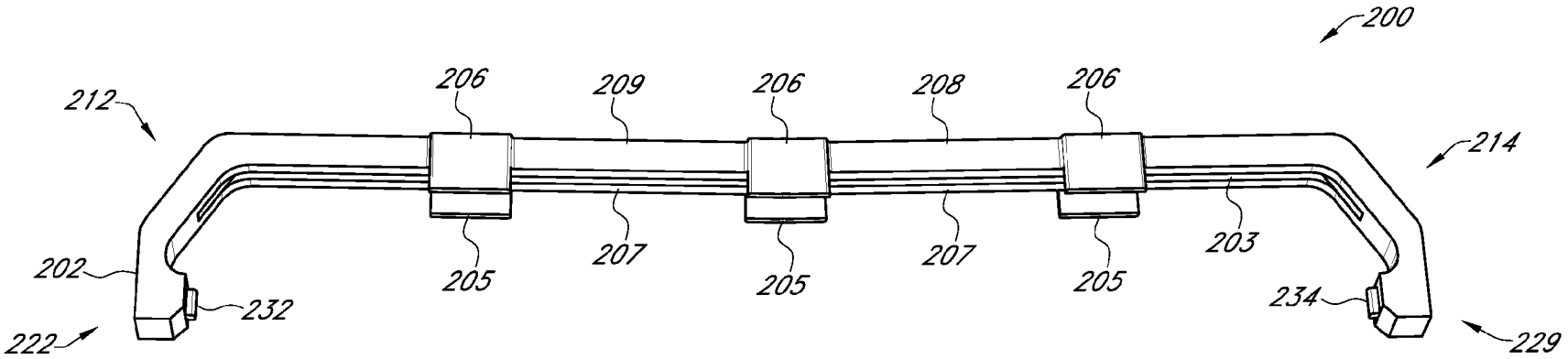
FIG. 2 is a perspective view of a retention clip of the present invention.

Now referring to FIG. 2, there is shown a retention clip 200 of the present invention, which comprises a retention clip first end 202, retention clip second end 204, a retention clip central portion 208, which has a retention clip central portion top side 209, a retention clip central portion bottom side 207 with a retention clip bottom side top edge receiving groove 203 therein. Retention clip central portion 208 has a retention clip first angled portion 212 and a retention clip second angled portion 214, which are adjacent to retention clip first latch engaging end 222 and retention clip second latch engaging end 224, respectively. Each of retention clip first angled portion 212 and retention clip second angled portion 214 has a memory module card corner receiving orifice 213 (FIG. 4) therethrough. Retention clip first latch engaging end 222 and retention clip second latch engaging end 224 have disposed thereon retention clip first latch engaging tab 232 and retention clip second latch engaging tab 234, respectively. Retention clip central portion 208 further has retention clip second face bumper spacer 205 and retention clip first face bumper spacer 206.

Retention clip 200 spans the longitudinal length of a standard JEDEC memory module such as DIMM memory module 110, such that each end, retention clip first end 202 and retention clip second end 204 of the retention clip 200, exerts through the retention clip first latch engaging end 222 and retention clip second latch engaging end 224, respectively; an inward pressure on the insertion and extraction of each latch; first pivoting latch 122 and second pivoting latch 124. The inward pressure is applied by retention clip 200 in such a way as to prevent rotation of first pivoting latch 122 and second pivoting latch 124 by exploiting the inherent tensile strength properties of the material from which it is constructed.

Key to the function of the retention clip 200 is the ability to flex around the first pivoting latch 122 and second pivoting latch 124 during the installation process of the DIMM memory module 110 into the DIMM connector 120, but provide adequate resistance to the inherent latch rotation during chassis deflection, which often occurs during operation of the compute platform. The retention clip 200 therefore must be resistant to elongation in some areas but allow for flexure in the areas necessary for rotating around the latches during installation. This is in essence a snap-fit approach to retaining the DIMM in the connector. Retention clip 200 has spring-like properties and can be made of any suitable material which provides for minimal stretching and compression in the longitudinal direction, but with the ability for limited flexing, bending or bowing in directions other than the longitudinal direction.

Figure 3:
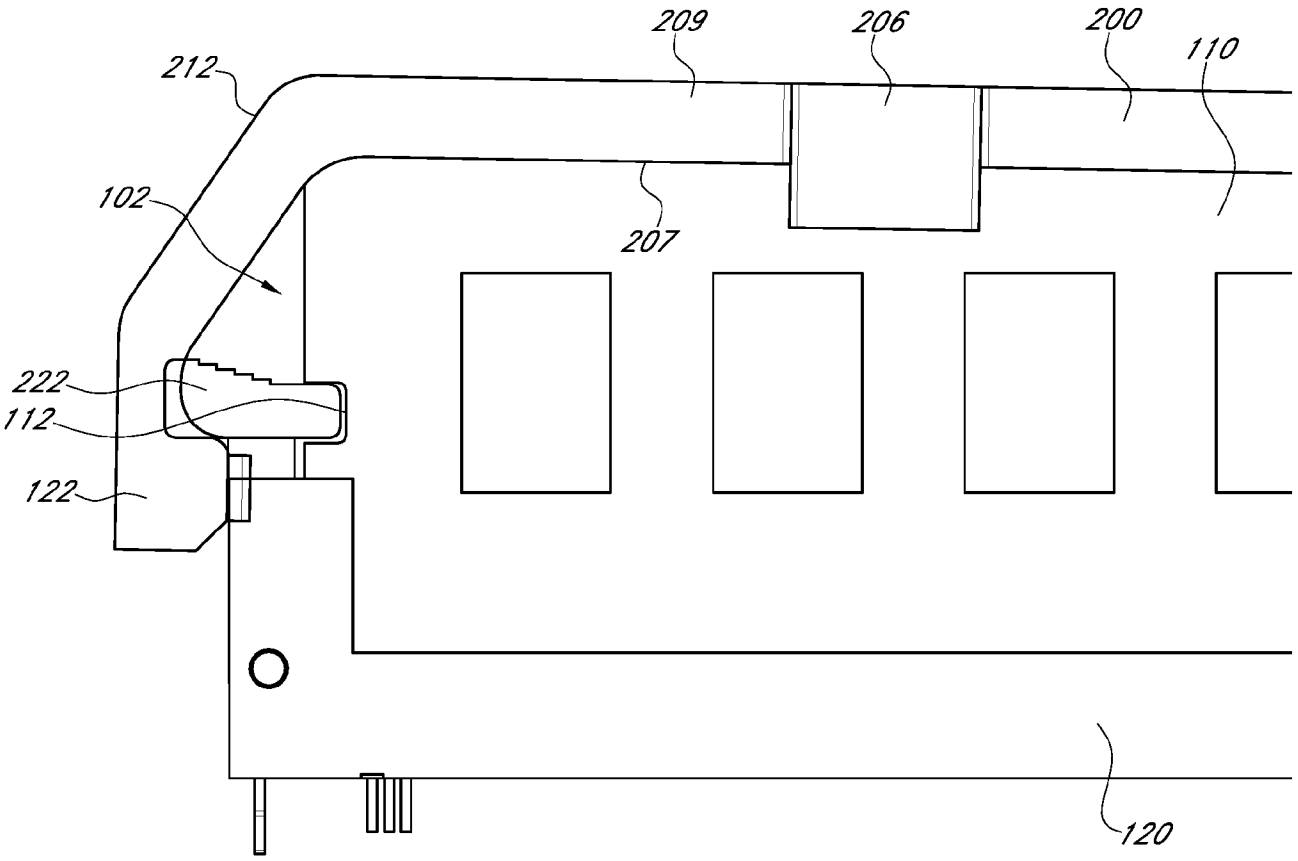
FIG. 3 is a perspective view of a portion of a retention clip system of the present invention which include the retention clip of FIG. 2 together with the latchable DIMM connector and memory module of FIG. 1 in an assembled configuration.

Now referring to FIG. 3, there is shown a portion of disconnection protected system which includes an installed DIMM memory module 110, in a DIMM connector 120 with a retention clip 200. More specifically there is shown; the first pivoting latch 122 disposed in a latched orientation with the retention clip first latch engaging end 222 portion of the retention clip 200 applying a biasing force on the first pivoting latch 122, which tends to keep the DIMM memory module 110 fully installed. Not visible in this Figure is retention clip first latch engaging tab 232, which is present but concealing inside a slot in first pivoting latch 122. A feature of the clip is the shape of the retention clip first latch engaging end 222 and retention clip second latch engaging end 224, which interface with first pivoting latch 122 and second pivoting latch 124. The angle of the retention clip 200 is designed to match that of the first pivoting latch 122 and second pivoting latch 124 such that a large force is required to allow rotation either latch.

Figure 4:
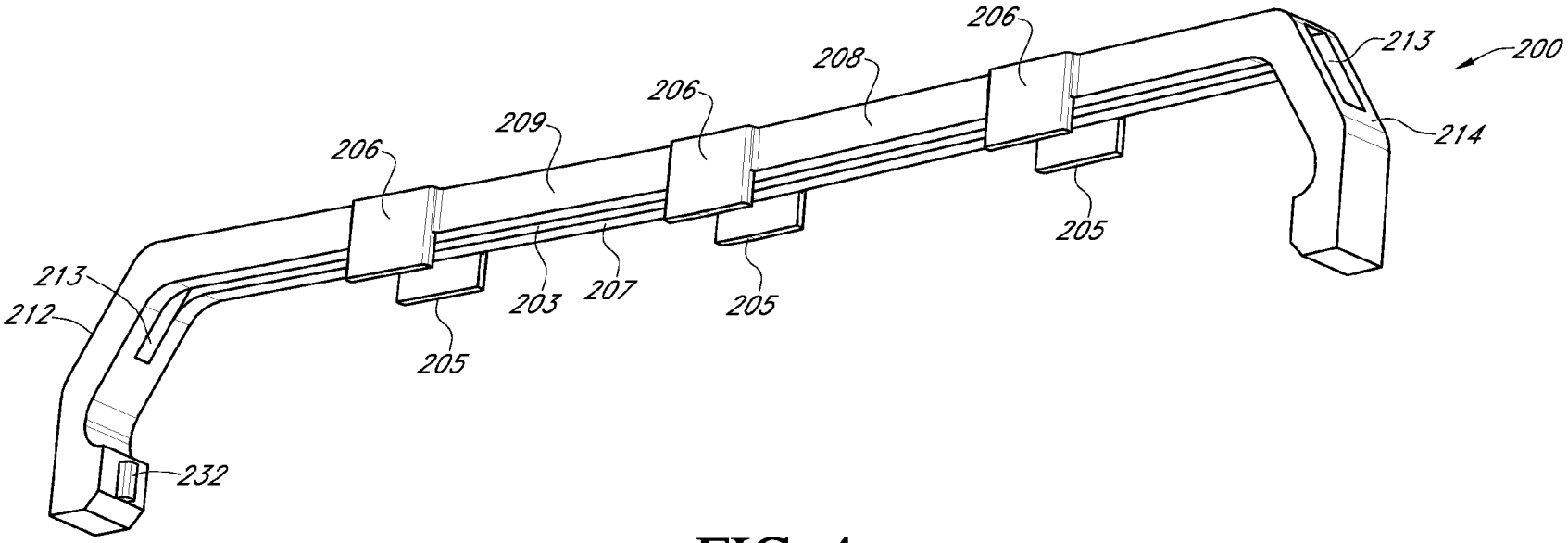
FIG. 4 is a perspective view of a portion of the retention clip of the present invention.

Now referring to FIG. 4 there is shown an additional view of the retention clip 200. More visible in FIG. 4 is retention clip bottom side top edge receiving groove 203, which is configured to receive thereon a memory module top edge 108. Memory module card corner receiving orifices 213 are clearly shown in retention clip first angled portion 212 and retention clip second angled portion 214.

Figure 5:
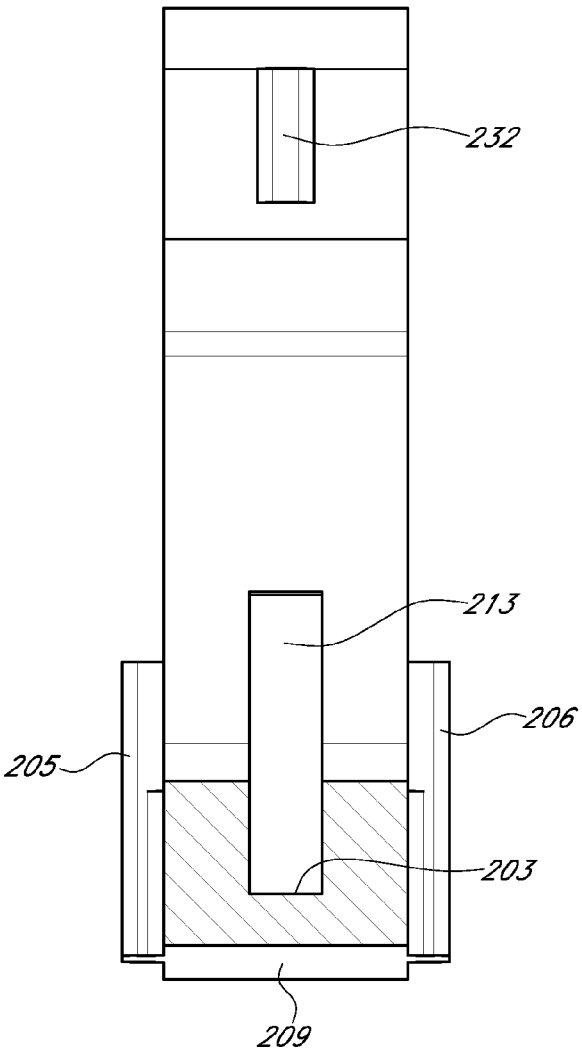
FIG. 5 is an upside down cross-sectional view of the retention clip from FIG. 4.

Now referring to FIG. 5, there is shown an upside down cross-sectional view of the retention clip 200 of FIG. 4 taken along retention clip central portion 208 at a point without a retention clip first face bumper spacer 206 of retention clip second face bumper spacer 205. The diagonally hatched portion represents the material of retention clip central portion 208 which would be "cut" to allow this view to exist. A preferred embodiment of the retention clip 200 uses a "C" channel construction along an edge of the retention clip 200 to restrain motion of the DIMM memory module 110 in a lateral direction when installed in DIMM connector 120.

Figure 6:
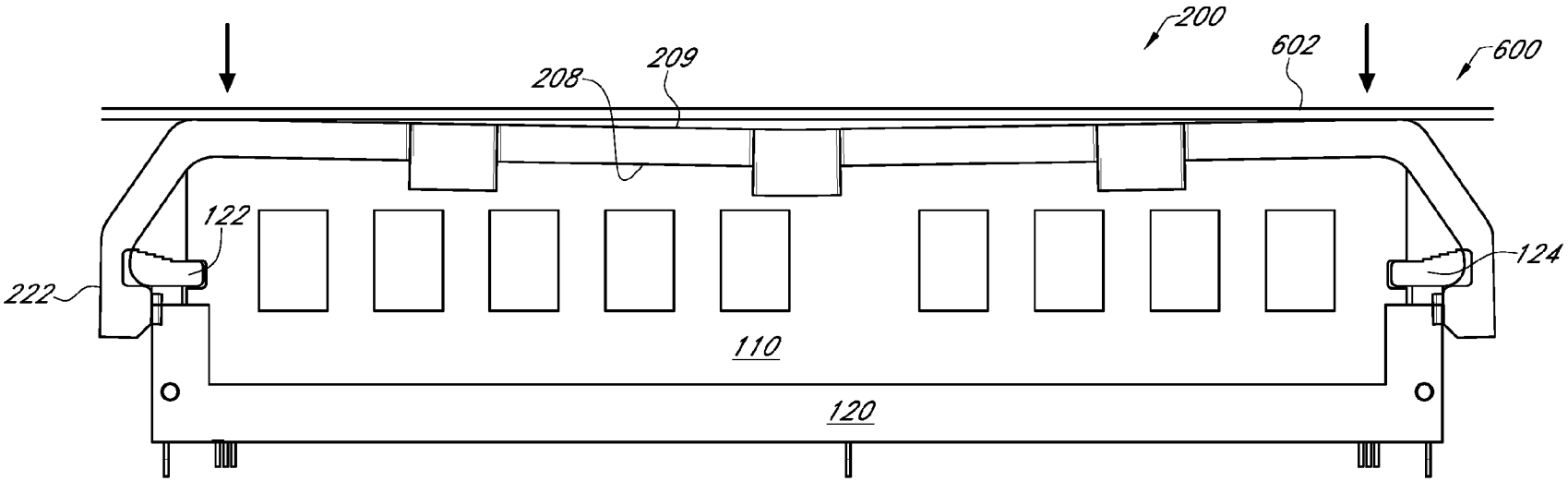
FIG. 6 is a cross-sectional view of the present invention, with a lid contacting the retention clip from FIG. 4.

Now referring to FIG. 6, there is shown side view of a first one of, and only shown one of, a parallel array of disconnection protected systems of the present invention in their intended environment including retention clip 200. Edge of lid 602 is shown disposed over the first one but extends of all of the series of parallel systems each of which includes a retention clip 200, DIMM memory module 110 and DIMM connector 120 such that the lid 602 contacts and applies a pressure on retention clip central portion top side 209 for each of this series of retention clips 200. First pivoting latch 122 and second pivoting latch 124 are shown in a latched configuration with the retention clip 200 applying inward force therein which resists disconnection inducing rotation of the first pivoting latch 122 and second pivoting latch 124. In this preferred embodiment, the retention clip 200 would also contain a feature which created contact with some removable chassis structure to prevent motion of a rotational nature. In the description herein, this structure is the lid 602 or cover of the chassis. Having this structural interference with the retention clip 200 prevents rotation of first pivoting latch 122 and second pivoting latch 124 and insures connectivity of the memory circuits, however this interference is not required to make the innovation useful. A similar example of this feature is a simple curvature of the retention clip central portion 208 such that the lid applies force to the retention clip first latch engaging end 222 and retention clip second latch engaging end 224. Since the material has some spring characteristics, the contact with the lid 602 creates a force on the ends of first pivoting latch 122 and second pivoting latch 124, which further secures the DIMM memory module 110 into the DIMM connector 120.

Figure 7:
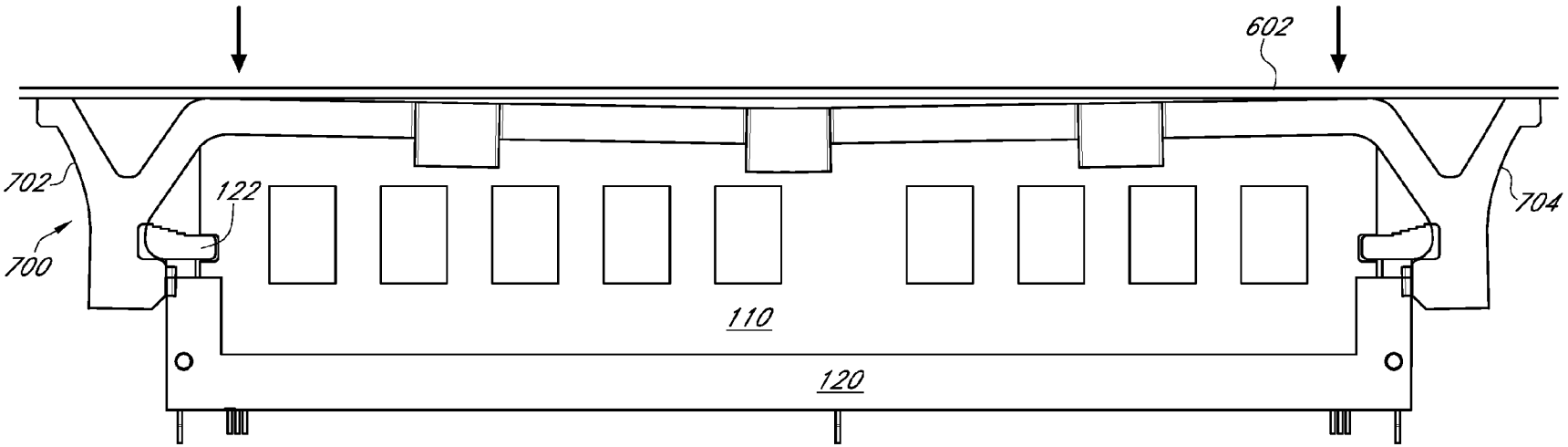
FIG. 7 is a cross-sectional view of an alternate embodiment of a retention clip of the present invention.

Now referring to FIG. 7, there is shown an alternate version of the present invention which includes buttressed retention clip 700, which is similar in many respects to retention clip 200 and which also includes first end lid contacting buttress 702 and second end lid contacting buttress 704 which can transmit force from the lid 602 to the first pivoting latch 122 and second pivoting latch 124 to provide additional biasing forces to prevent inadvertent rotation of the first pivoting latch 122 and second pivoting latch 124. Additionally, a feature of the buttressed retention clip 700 is to capture the memory module top edge 108 near the jes602 to resist lateral motion of the DIMM memory module 110 either through the resistance of the buttressed retention clip 700 to deflect laterally or by pressure applied by the lid 602.

Figure 8:
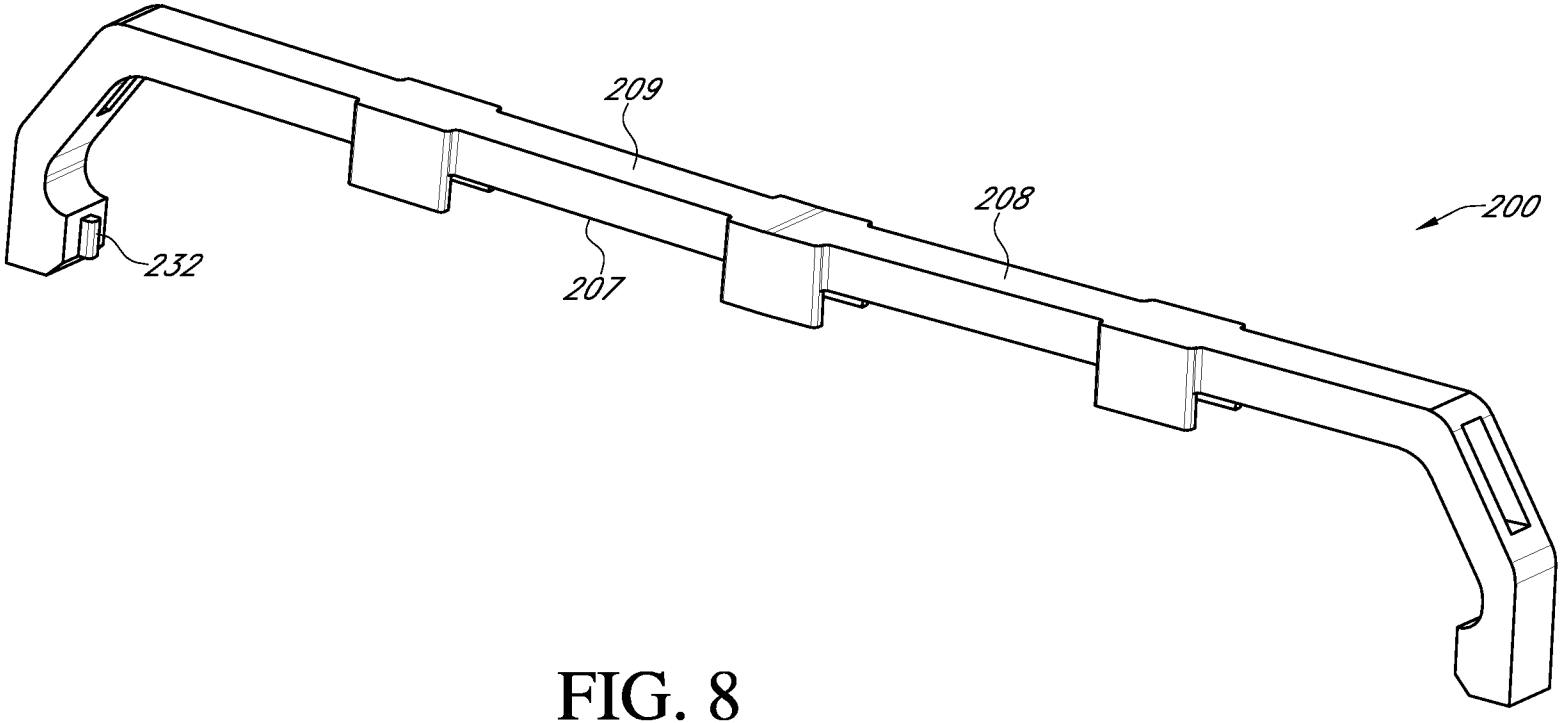
FIG. 8 is a perspective view of the retention clip of the present invention from a different angle than FIGS. 2 and 4.

Now referring to FIG. 8, there is an alternate view of the retention clip 200, but from a more downwardly looking viewpoint.

Figure 9:
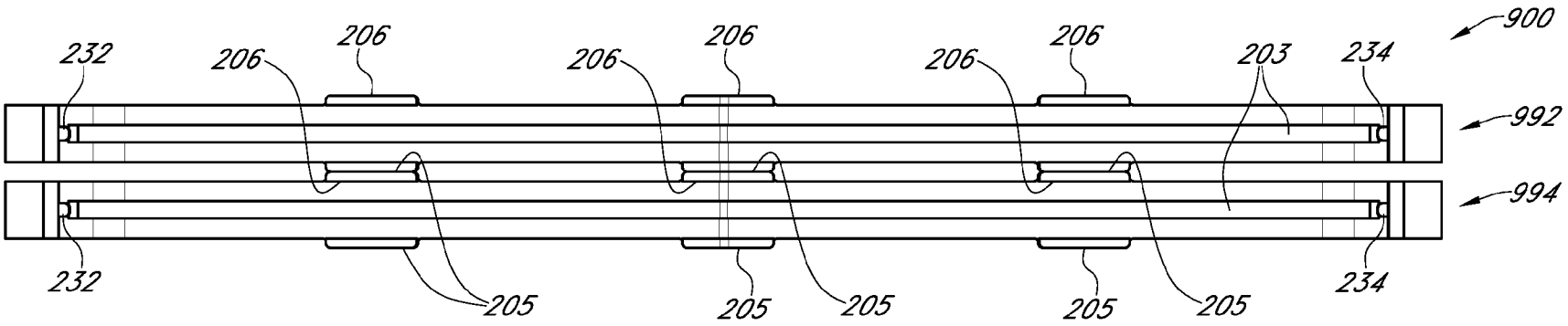
FIG. 9 is a bottom view of a pair of adjacent retention clips of the present invention showing relationship between bumper spaces on adjacent retention clips.

Now referring to FIG. 9, there is shown an upwardly looking view, of a parallel array of retention clips 200 which shows retention clip bottom side top edge receiving groove 203 and it also shows how a retention clip second face bumper spacer 205 of first parallel retention clip 992 contacts a retention clip first face bumper spacer 206 of second parallel retention clip 994, which helps to prevent lateral motion of the DIMM memory module 110. An additional feature of the retention clip 200 or buttressed retention clip 700 is to provide a self-aligning feature that allows for proper lateral spacing of the clips. This feature would be in the form of tapered retention clip second face bumper spacers 205 and retention clip first face bumper spacer 206 in the most obvious example, which guided one clip which was adjacent to another clip, such that alignment of second clip was optimum for installation on the second DIMM memory module.

Figure 10:
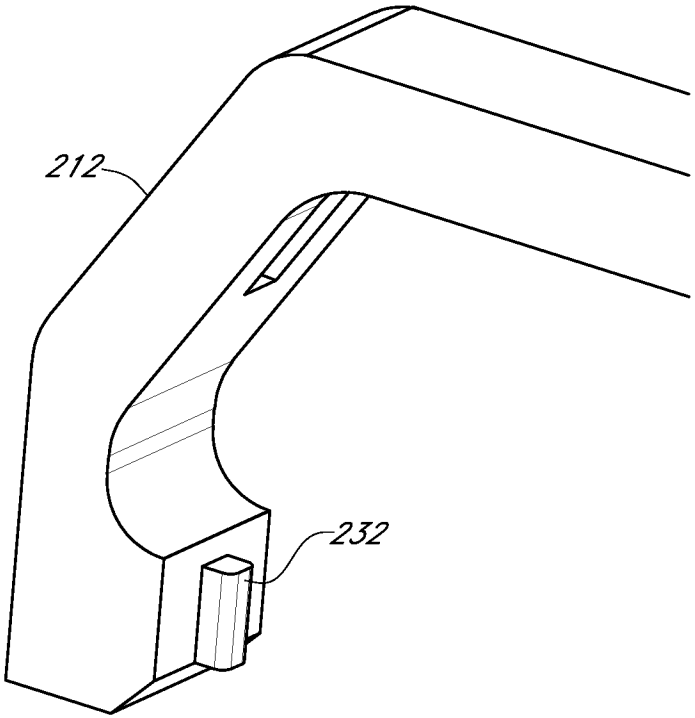
FIG. 10 is a close up view of a portion of the retention clip of FIG. 8.

Now referring to FIG. 10, there is shown a close up view of the retention clip first end 202, which includes retention clip first latch engaging tab 232 which is on an interior side of retention clip first latch engaging end 222 and is designed to fit into a slot in first pivoting latch 122 during installation. The slot is present as a feature for the operation of the extraction and insertion action. The purpose of the retention clip first latch engaging tab 232 and retention clip second latch engaging tab 234 is to further deter rotation of the latch mechanism of the DIMM connector 120 by preventing upward motion on the retention clip 200, thereby separating it from the DIMM memory module 110 and DIMM connector 120 pair.

Figure 11:
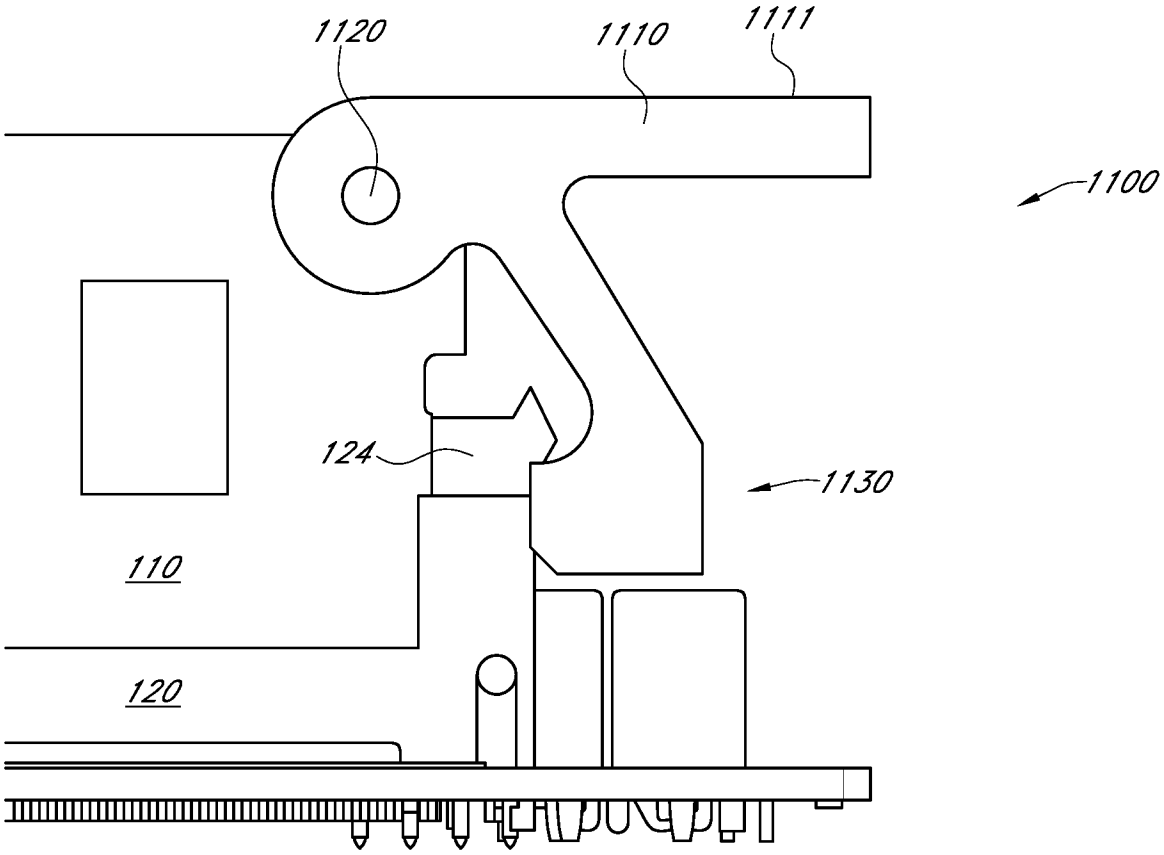
FIG. 11 is a side view of an attached pivoting retention clip of the present invention.

Now referring to FIG. 11, there is shown an alternative feature of the present invention, which includes: member for transmitting latch effecting forces 1110 with a top surface 1111. Member for transmitting latch effecting forces 1110 is connected to DIMM memory module 110 via module mounting structure 1120, which can be a rivet, peg or other structure which may or may not permit rotation of the member for transmitting latch effecting forces 1110 thereabouts. Latch engaging structure 1130 is similar in design and function to retention clip second latch engaging end 224. An additional advantage of this feature of the invention is to attach the retention clips directly to the memory modules using the JEDEC specified standard hole pattern on the module to fix the clip directly to the module using a pin or a rivet type of fastener, thereby eliminating loose pieces in the system.

Throughout this description, reference is made to an industrial PC and to a printed circuit board, because it is believed that the beneficial aspects of the present invention would be most readily apparent when used in connection with industrial PCs and printed circuit boards; however, it should be understood that the present invention is not intended to be limited to industrial PCs and printed circuit boards and should be hereby construed to include other non-industrial PCs and non-printed circuit boards as well.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

We claim:

1. A system for reducing inadvertent disconnection of memory modules during operation in harsh environments comprising:

a plurality of disconnection protected systems arranged in a parallel array; wherein each of said plurality of disconnection protected systems comprises:

a DIMM connector 120;

a DIMM memory module 110, having a memory module top edge 108;

a retention clip 200 having:

a retention clip central portion 208, having a retention clip first end 202 and retention clip second end 204;

a retention clip first angled portion 212 and retention clip second angled portion 214 disposed on opposing ends of said retention clip central portion 208;

a retention clip first latch engaging end 222 and a retention clip second latch engaging end 224 disposed on said retention clip first angled portion 212 and retention clip second angled portion 214, respectively;

said retention clip central portion 208 having a retention clip central portion top side 209 and a retention clip central portion bottom side 207, which has a retention clip bottom side top edge receiving groove 203 disposed therein, which is configured to receive therein said memory module top edge 108;

a plurality of retention clip first face bumper spacers 206;

a plurality of retention clip second face bumper spacers 205;

a retention clip first latch engaging tab 232 disposed on an interior side of said retention clip first latch engaging end 222;

a retention clip second latch engaging tab 234 disposed on an interior side said retention clip second latch engaging end 224 facing said retention clip first latch engaging tab 232; and wherein said array is spatially configured such that each retention clip 200 in said plurality of disconnection protected systems has at least one of said plurality of retention clip first face bumper spacers 206 and said plurality of retention clip second face bumper spacers 205 thereon in contact with one of said plurality of retention clip first face bumper spacers 206 and said plurality of retention clip second face bumper spacers 205 of another retention clip 200 of said plurality of disconnection protection systems.

2. A system for reducing inadvertent disconnection of memory modules during operation in harsh environments comprising:

a DIMM connector, having a first pivoting latch and a second pivoting latch;

a DIMM memory module, having a memory module top edge;

a retention clip having:

a retention clip central portion having a retention clip central portion top side, a retention clip central portion bottom side, a retention clip central portion first face extending between said retention clip central portion bottom side and said retention clip central portion top side, a retention clip central portion second face opposite said retention clip central portion first face;

a retention clip first latch engaging end and a retention clip second latch engaging end engaged with opposing ends of said DIMM memory module and disposed beneath and in contact with an upper portion of said first pivoting latch and said second pivoting latch, respectively;

wherein said retention clip first latch engaging end and said retention clip second latch engaging end each provide a biasing force which tends to prevent rotation of first pivoting latch and second pivoting latch, respectively;

a retention clip bottom side top edge receiving groove disposed in said retention clip central portion bottom side and running along a longitudinal axis of said retention clip aligned with a line drawn from said retention clip first latch engaging end and said retention clip second latch engaging end;

said retention clip bottom side top edge receiving groove having a depth dimension which is orthogonal to said longitudinal axis and which limits an insertion distance of said memory module top edge;

said retention clip further having a retention clip first face bumper spacer which protrudes from said retention clip central portion first face in a direction which is orthogonal to both said longitudinal axis and said depth dimension; and said retention clip further having a retention clip second face bumper spacer which protrudes from said retention clip central portion second face in a direction which is orthogonal to both said longitudinal axis and said depth dimension.

3. The system of claim 2 wherein said retention clip first latch engaging end and retention clip second latch engaging end are pivotably mounted to opposing ends of said DIMM memory module.

4. The system of claim 2 wherein said retention clip first latch engaging end and retention clip second latch engaging end are disposed on opposing ends of a retention clip central portion which is disposed on said memory module top edge.

5. The system of claim 4 further comprising:

a plurality of retention clip first face bumper spacers disposed on said retention clip central portion; and a plurality of retention clip second face bumper spacers disposed on said retention clip central portion.

6. The system of claim 4 wherein said retention clip central portion further comprises:

a. a retention clip central portion bottom side; and b. a retention clip bottom side top edge receiving groove disposed in said retention clip central portion bottom side, which is configured to receive therein said memory module top edge.

7. The system of claim 4 wherein said retention clip central portion further comprises: a retention clip central portion top side positioned and configured to be contacted by a lid.

8. The system of claim 7 further comprising a first end lid contacting buttress and a second end lid contacting buttress.

9. The system of claim 2 wherein said retention clip first face bumper spacer comprises a first plurality of spaced apart protuberances on said retention clip central portion first face.

10. The system of claim 9 wherein said retention clip second face bumper spacer comprises a second plurality of spaced apart protuberances on said retention clip central portion second face.

11. The system of claim 10 wherein each of said first plurality of spaced apart protuberances is disposed opposite of one of said second plurality of spaced apart protuberances.

12. A system for reducing inadvertent disconnection of memory modules during operation in harsh environments comprising:

a DIMM connector, having a first pivoting latch and a second pivoting latch;

a DIMM memory module, having a memory module top edge;

a retention clip system having:

a retention clip first latch engaging end and a retention clip second latch engaging end engaged with opposing ends of said DIMM memory module and disposed beneath and in contact with an upper portion of said first pivoting latch and said second pivoting latch, respectively;

wherein said retention clip first latch engaging end and said retention clip second latch engaging end each provide a biasing force which tends to prevent rotation of first pivoting latch and second pivoting latch, respectively:

a retention clip first latch engaging tab disposed on said retention clip first latch engaging end;

a retention clip second latch engaging tab disposed on said retention clip second latch engaging end; and wherein said retention clip first latch engaging tab and retention clip second latch engaging tab are configured to fit inside a slot in first pivoting latch and second pivoting latch, respectively.

13. The system of claim 12 wherein said retention clip first latch engaging end and retention clip second latch engaging end are pivotably mounted to opposing ends of said DIMM memory module.

14. The system of claim 12 wherein said retention clip first latch engaging end and retention clip second latch engaging end are disposed on opposing ends of a retention clip central portion which is disposed on said memory module top edge.

15. A method of reducing inadvertent disconnection of memory modules during operation in harsh environments comprising the steps of:

providing a retention clip configured with a retention clip first latch engaging end and a retention clip second latch engaging end:

providing a retention clip first latch engaging tab disposed on an interior side of said retention clip first latch engaging end;

providing a retention clip second latch engaging tab disposed on an interior side said retention clip second latch engaging end facing said retention clip first latch engaging tab;

installing a DIMM memory module into a DIMM connector having a first pivoting latch and a second pivoting latch;

engaging said retention clip with all of said DIMM memory module;

and using said retention clip first latch engaging tab and retention clip second latch engaging tab for, engaging said retention clip first latch engaging end and said retention clip second latch engaging end respectively, with said first pivoting latch and said second pivoting latch, respectively.

* * * * *